US008574029B2

(12) United States Patent
Bettermann et al.

(10) Patent No.: US 8,574,029 B2
(45) Date of Patent: Nov. 5, 2013

(54) ORBITAL GRINDING AGGREGATE

(75) Inventors: Thomas Bettermann, Bielegeld (DE); Hans-Bernd Humpe, Beckum (DE)

(73) Assignee: Buetfering Schleiftechnik GmbH, Beckum (DE)

( * ) Notice: Subject to any disclaimer, the term of this patent is extended or adjusted under 35 U.S.C. 154(b) by 590 days.

(21) Appl. No.: 12/416,951

(22) Filed: Apr. 2, 2009

(65) Prior Publication Data

US 2010/0003895 A1 Jan. 7, 2010

(30) Foreign Application Priority Data

Jul. 1, 2008 (EP) ..... 08159456

(51) Int. Cl.
*B24B 7/02* (2006.01)
*B24B 21/08* (2006.01)
*B24B 55/08* (2006.01)

(52) U.S. Cl.
USPC ..... 451/28; 451/166; 451/168; 451/270; 451/304; 451/456

(58) Field of Classification Search
USPC ..... 451/28, 163, 166, 168, 303, 304, 456, 451/49, 124, 127, 150–152
See application file for complete search history.

(56) References Cited

U.S. PATENT DOCUMENTS 2,787,100 A 4/1957 Peyches
3,013,323 A 12/1961 Williams
3,754,354 A * 8/1973 Franlinna ..... 451/167
4,485,859 A * 12/1984 Krogstad et al. ..... 144/252.1
4,742,650 A 5/1988 Sauder, Jr. et al.
5,707,273 A * 1/1998 Grivna ..... 451/163
6,200,206 B1 3/2001 Drees
6,276,988 B1 * 8/2001 Chen ..... 451/5
6,533,648 B2 * 3/2003 Drees ..... 451/182
7,241,207 B2 * 7/2007 Heesemann ..... 451/59
2005/0233681 A1 10/2005 Jost

FOREIGN PATENT DOCUMENTS

WO WO 2004/020146 3/2004

* cited by examiner

*Primary Examiner* — Dung Van Nguyen

(74) *Attorney, Agent, or Firm* — Harness Dickey & Pierce, PLC

(57) ABSTRACT

The invention concerns a grinding machine having displaceable grinding means for the processing of workpieces made from wood, wood composite materials, plastics, metals and similar materials. The invention further concerns a method of grinding a workpiece by means of the inventive grinding machine. The grinding aggregate comprises: at least one translational driving means configured to translate the grinding means (6) and at least one eccentric tappet configured to rotatingly move the grinding means (6). The inventive device is characterized in that the grinding aggregate comprises a suctioning device which suctions waste products of the processing, such as chips, through the grinding means. In this way, it is possible to achieve a qualitatively superior grinding result.

20 Claims, 9 Drawing Sheets

ORBITAL GRINDING AGGREGATE

FIELD OF THE INVENTION

The invention concerns a grinding aggregate having displaceable grinding means for the processing of workpieces made of wood, wood composite materials, plastics, metals and similar materials. The invention further concerns a method of grinding a workpiece by means of the inventive grinding aggregate.

PRIOR ART

A generic grinding machine is known for example from the European patent having the number EP 1 530 509 B1. This grinding machine comprises oscillating driving means, that is an excentric shaft and an electric motor for putting the grinding means into an oscillating grinding motion. The grinding machine of EP 1 530 509 B1 is characterized in that the activation means for holding the grinding means comprises a plurality of ribs so that different regions of the grinding means can be alternately activated independently of the oscillating grinding motion.

The grinding machine of EP 1 530 509 B1 is configured as a tape grinding machine so that the activation means moves the grinding tape, which moves when the workpiece passes through, by means of a dual superimposed motion in a massaging way. The dual superimposed motion consists of a dual orbital motion.

SUMMARY OF THE INVENTION

It is an object of the invention to provide a grinding aggregate by means of which an improved grinding pattern having very few visually recognizable grinding traces can be generated and by means of which also compound workpieces, each with different surface configurations such as, in particular, the fiber direction in wooden materials, may be processed in a way that they result in a uniform pattern.

This object is achieved by means of a grinding aggregate of a grinding machine according to claim 1 as well as a method according to claim 13. Preferred embodiments are defined in the dependent claims.

According to the invention, a grinding aggregate having a displaceable grinding means is provided, comprising the following elements: at least one translational driving means configured to translate the driving means and at least one eccentric tappet configured to rotatingly move the grinding means. The inventive grinding aggregate is characterized in that it further comprises a suction device which suctions waste products of the processing operation, for example chips, through the grinding means.

This suctioning through the grinding means is also called internal suctioning, in which the grinding means is formed as so-called air and dust permeable grinding means. By means of the internal suctioning it is possible to clean the grinding means directly during grinding. The oscillating movement of the grinding means contributes to the grinding waste products not being able to deposit in the grinding means. This synergy effect increases the lifespan of the grinding means to great extent and has the advantage that external suctioning is not necessary or only necessary in certain cases.

The grinding dust created by the grinding operation is suctioned through an air and dust permeable grinding means. The air and dust permeable grinding means is, on the one hand, envisioned for use with a tape grinder or, on the other hand, as preferred within the framework of the present invention, with a grinding aggregate having a so-called grinding tongue, that is a fixed grinding means.

Apart from the already mentioned aspect of suctioning, the dual superimposed motion of the grinding means ensures that by blurring the grinding patterns of the processed workpieces the latter are provided with a superior visual appearance. With wooden frames composed of several single elements, for example, the advantage is that the grinding across the grain is no longer discernible. Also, workpieces composed of several elements can be grinded such that the observer is given a uniform pattern (image) of the processed surface. However, the invention is not limited to wood as a material. Also wood composite materials, plastics or metals may be processed with the inventive device as well as with the inventive method. The elements for exciting the individual motions may each be controlled independently, whereby all parameters such as speed and amplitude can be adjusted independently of each other. Further, all elements for exiting the individual motions can be switched on or off independently of each other.

Within the framework of the invention, the grinding means may be configured in a variety of ways. With respect to suctioning, lifespan and grinding result it turned to be particularly advantageous if the grinding means has at least in sections a porous and/or web-like structure.

According to a further embodiment of the invention, it is moreover envisioned that the grinding means has a grinding surface facing the workpiece and that the suctioning device faces the surface of the grinding means opposite to the grinding surface. Thereby, a particularly efficient suctioning of the grinding means ensues contributing also to an increased lifespan and a good grinding result.

Moreover, it is envisioned according to a further embodiment of the invention that the grinding aggregate comprises a grinding means holder for holding and pressing the grinding means onto a workpiece, which defines a plurality of through holes facing the suctioning device. The grinding means holder thus advantageously incorporates two functions, that is the holding and pressing-on of the grinding means, on the one hand, and the targeted abutting of the suctioning device against the grinding means, on the other hand. Thereby, not only the number of components may be reduced and the structure thus simplified, but also particularly advantageous flow characteristics result which contribute to an efficient suctioning.

In order to keep low the number of parts that need to be exchanged upon replacing the grinding means, it is envisioned according to a further embodiment of the invention that the grinding means is releasably attached to the grinding means holder, in particular by means of a hook-and-loop fastener. Thereby, the replacement of the grinding means may be performed rapidly and with little effort, if required, without curtailing the efficiency of the suctioning or the grinding result.

In a further preferred embodiment the grinding aggregate comprises at least one oscillating module holding the grinding means, which is configured to put the grinding means into an oscillating motion. Thus, according to this embodiment, the grinding means is excited with respect to the workpiece moving along the grinding means by means of three motions that are independent from each other so that the grinding aggregate of this embodiment is adapted to ensure an additional blurring or unitizing of the grinding patterns of the processed workpieces.

A further preferred embodiment of the grinding aggregate provided with an oscillating module is characterized in that the oscillating module is oscillatingly moved in itself in the frequency range of preferably 30 to 100 Hz. Such an oscillating motion helps to achieve the desired grinding result. Further, the grinding waste products such as chips and dust may be detached again from the grinding means or are not able to deposit onto the grinding means.

Preferably, the grinding aggregate is further characterized in that the oscillating module comprises an upper and lower part which can be moved against each other. By means of these movements against each other, the motion of the oscillating module a such may be realized so that the overall center of gravity of the oscillating module remains substantially the same.

Further, it is preferred that at least one grinding means is mounted at the lower part of the oscillating module. This grinding means is now contacted with a workpiece to be processed. The mounting operation itself may be performed in various ways, for instance by clamping, screwing or the use of an adhesive.

In a preferred embodiment, the grinding aggregate provided with the oscillating module is characterized in that the upper and the lower part are moved by means of oscillating magnets which oscillating magnets are preferably arranged at an angle of substantially 90° toward each other. The use of oscillating magnets thus ensures that the oscillating motion of the upper and the lower part against each other may be performed in the desired frequency range. This leads to the desired grinding result. By arranging the oscillating magnets at an angle of 90° toward each other, it is, therefore, possible to achieve an oscillating motion generating a preferred pattern.

Herein, it is particularly preferred to control the oscillating magnets alternately in such a way that the lower part is moved in a triangular-like shape with respect to the upper part. Further, it is preferably envisioned to provide two pairs of oscillating magnets between the upper and the lower part. These two pairs of oscillating magnets may thus be provided each on a side of the longitudinally extending upper part and, correspondingly, of the longitudinally extending lower part. In this way, a stable oscillating motion is ensured. Also, tilting (tipping over) and wedging (canting) of the lower part supporting the grinding means may effectively and safely be avoided.

It has to be emphasized, however, that arranging the oscillating magnets at an angle of 90° to each other is not limiting for the present invention. An arrangement at a different angle correspondingly leads to the development of another motion pattern. Even arranging the oscillating magnets at an angle of 180° is conceivable, which would entail substantially a translational motion.

Further, it is preferred that the at least one eccentric tappet performs an oscillating motion between the oscillating module holding the grinding means and a cartridge element. Seen from the grinding means, the upper and lower part and, therefore, also the grinding means itself are thus put into a rotational motion.

Further, it is preferred that the cartridge element performs the translational motion with respect to a fixed supporting housing of the grinding aggregate by means of the translational driving means. The translational motion of the cartridge element and, thus, of the upper and lower part and hence the grinding means, too, is therefore a type of basic oscillating motion.

The grinding aggregate of the present invention, which is provided with an oscillating module, is preferably characterized in that the actuation of the at least one eccentric tappet is performed via an angle drive by means of a v-belt pulley laterally attached to the cartridge element. Thus, it can be made sure that the excitation of the eccentric tappet is always guaranteed despite the basic translational oscillation mentioned above. The transmission via a v-belt pulley is a simple and cost effective design. If the cartridge element, the upper and the lower part and, thus, also the grinding means are put into a translational motion with respect to the fixed support housing, the desired rotational motion of the eccentric tappet due to movable v-belt pulley can be ensured at any time. In fact, the latter performs the prescribed translational motion itself, but the driving force can continue to be transmitted.

In a preferred embodiment the grinding aggregate provided with the oscillating module is characterized in that the driving means moves the cartridge element in a translational direction, wherein the translational direction may be transverse to a workpiece conveying direction.

In other words, the desired grinding result is achieved according to the present embodiment as follows: the workpiece to be processed is conveyed with respect to the grinding means in a certain direction. Transverse to this direction the grinding means is moved by means of the translational driving means. This translational grinding motion by means of the translational driving means is superimposed by the rotational motion of the eccentric tappet as well as the oscillating motion of the oscillating module. Thus, the inventive grinding aggregate performs three grinding motions which are independent from each other, wherein the workpiece is additionally moved in a translational direction with respect to the grinding means.

Further, the present invention comprises a method of grinding panel-shaped workpieces, which method comprises the following steps: introducing a workpiece into a processing region so that the workpiece is contacted by a grinding means, moving the grinding means with at least two motions independent of each other, namely a translational and a rotational motion, grinding the workpiece with the grinding means thus moved, while suctioning the waste products of the processing such as chips through the grinding means.

By this inventive method the superposition of two grinding motions can provide the processed workpiece with a superior visual appearance or a very good surface structure. This is also true for workpieces which, in their unprocessed state, have an irregular surface structure or for workpieces composed of several elements. The superior processing result is further considerably determined by the suctioning through the grinding means because processing residues may be discharged directly. Further, the suctioning through the grinding means provides the advantage that the operating life of the grinding aggregates can be increased. In other words, the grinding means may be utilized longer without any need of replacement. Consequently, this results in longer maintenance intervals and thus contributes to an increase in cost effectiveness of a grinding machine.

According to a preferred embodiment of the inventive method, the step of moving the grinding means further comprises an oscillating motion, which is a triangular-like motion, wherein the motion is preferably generated by means of at least two oscillating magnets aligned substantially at 90° to each other, wherein the oscillating magnets are alternately excited preferably in range of 30 to 100 Hz. The angle of 90° describing the alignment of the oscillating magnets with respect to each other is not, however, to be regarded as limiting. Every other angle is conceivable within the framework of the invention and correspondingly entails a different motion pattern of the grinding means. While angles of 0 to 180° change the triangular-like form of movement, an angle of 180° results in a translational motion, for example.

Further, the method is preferably characterized in that during grinding the workpieces are moved with respect to the grinding means in one direction, preferably by means of a conveyer belt. In other words, the grinding means is, on the one hand, thus excited by means of a triply superimposed motion, while the workpiece fed through is moved past the operating grinding means. Thus, the method is also suitable for a large batches, and a high throughput can be achieved.

The inventive method is preferably characterized in that all grinding motions are performed substantially in one plane. This plane is to be intended as the one in which the grinding means engages the preferably panel-shaped workpieces to be processed. In other words, the plane is determined by the surface of the workpieces to be processed.

In a further embodiment, the method is characterized in that the rotational motion is exited by means of the at least one eccentric tappet. Herein, it is conceivable that the rotational motion may be a circular or an elliptic motion. The choice is governed inter alia by the desired grinding result.

Moreover, according to a further aspect of the present invention, a device according to claim 6 as well as a method according to claim 18 are provided in order to solve the problem described at the beginning and to achieve the same objects that were already mentioned. Further, this device and this method provide the same advantages as already stated.

SHORT DESCRIPTION OF FIGURES

In the following, the present invention is illustrated by way of example by means of the attached figures.

FIG. 1 shows the grinding aggregate of a grinding machine according to the present invention.

FIGS. 2*a* to 2*c* show side views and a top view, respectively, of the grinding aggregate according to the present invention. Here, FIG. 2*a* is a side view of a longitudinal side of the grinding aggregate, FIG. 2*b* is a side view of a transverse side of a grinding aggregate, and FIG. 2*c* is a top view of the grinding aggregate shown in FIG. 1.

Figure 5:
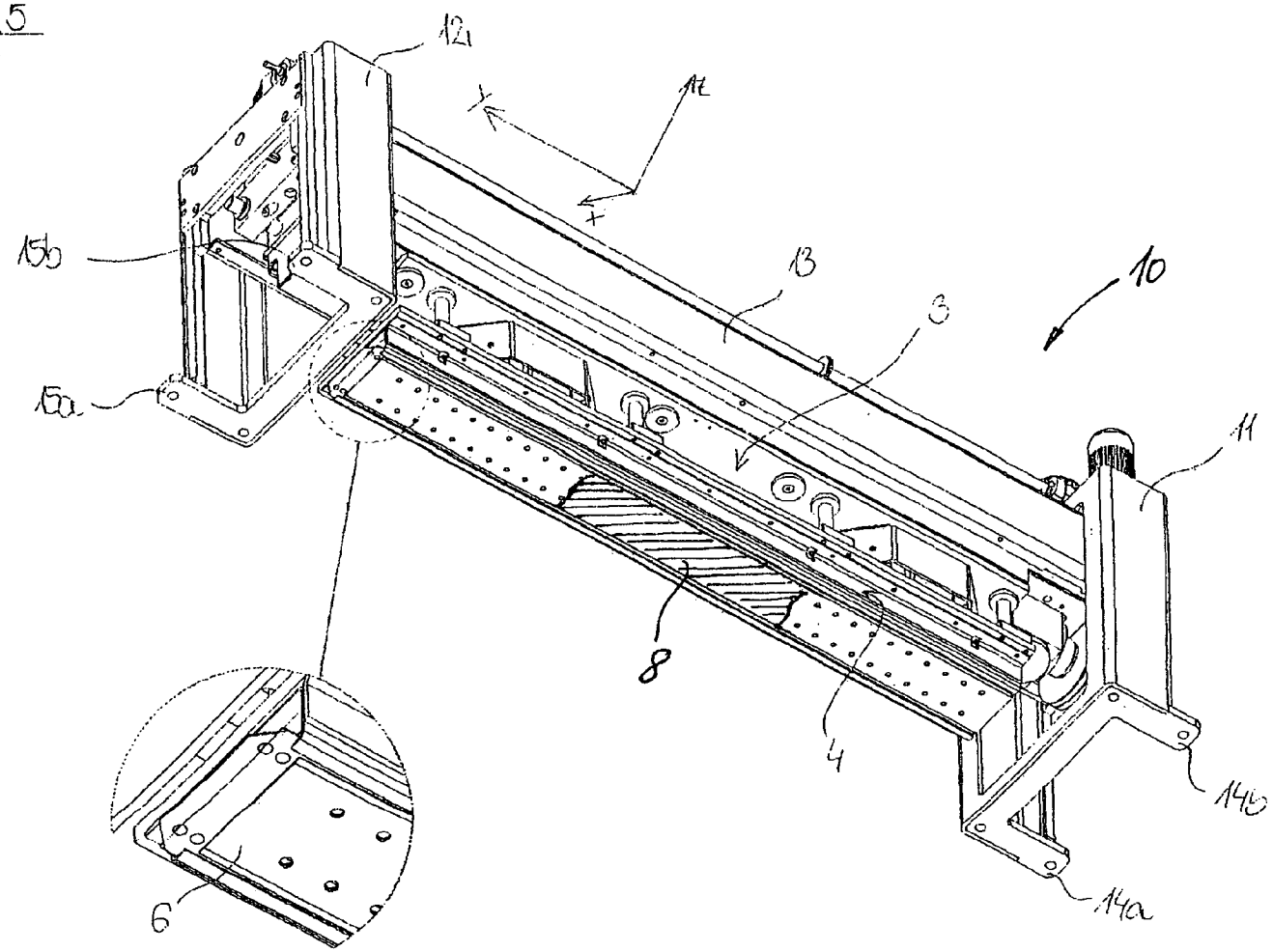

FIG. 5 corresponds to the grinding aggregate shown in FIG. 1, wherein in this view the grinding aggregate is shown from below.

Figure 6:
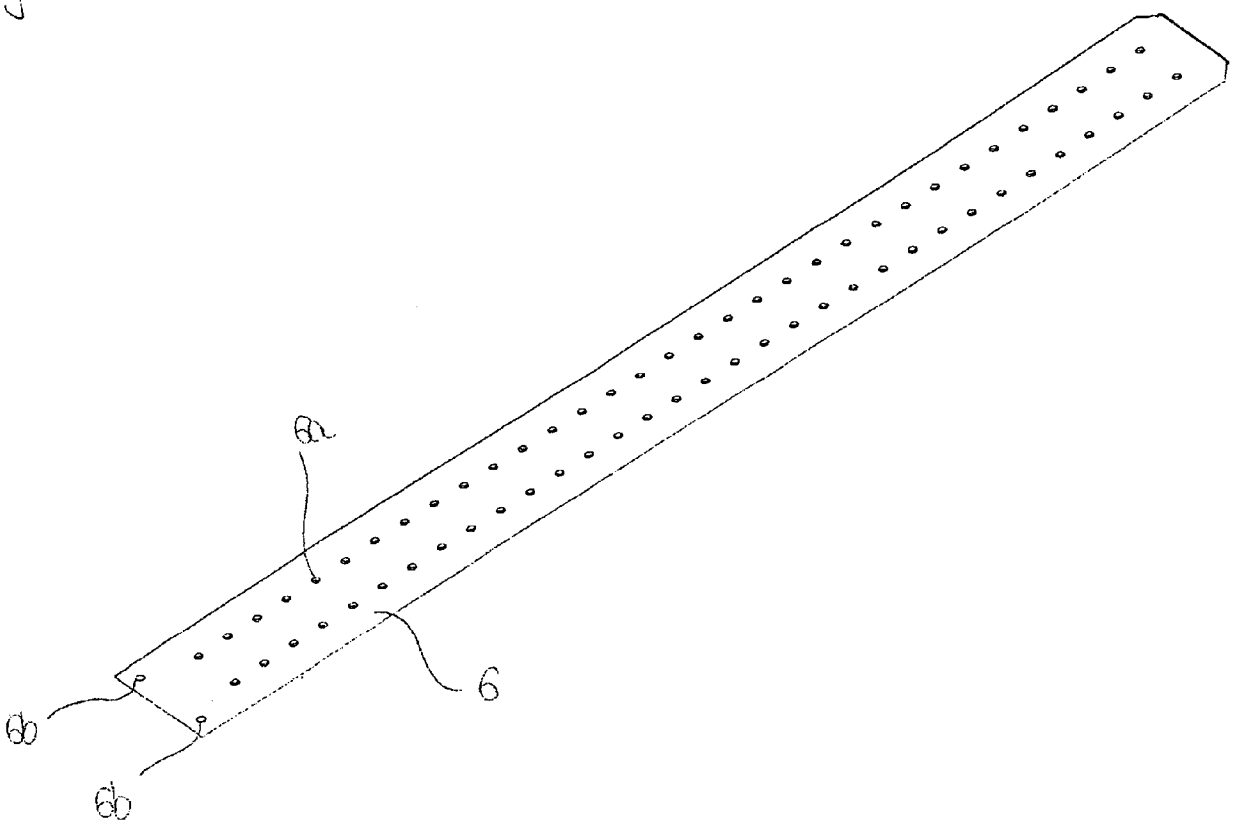

FIG. 6 shows a grinding tongue that can already be recognized in FIG. 5.

Figure 7:
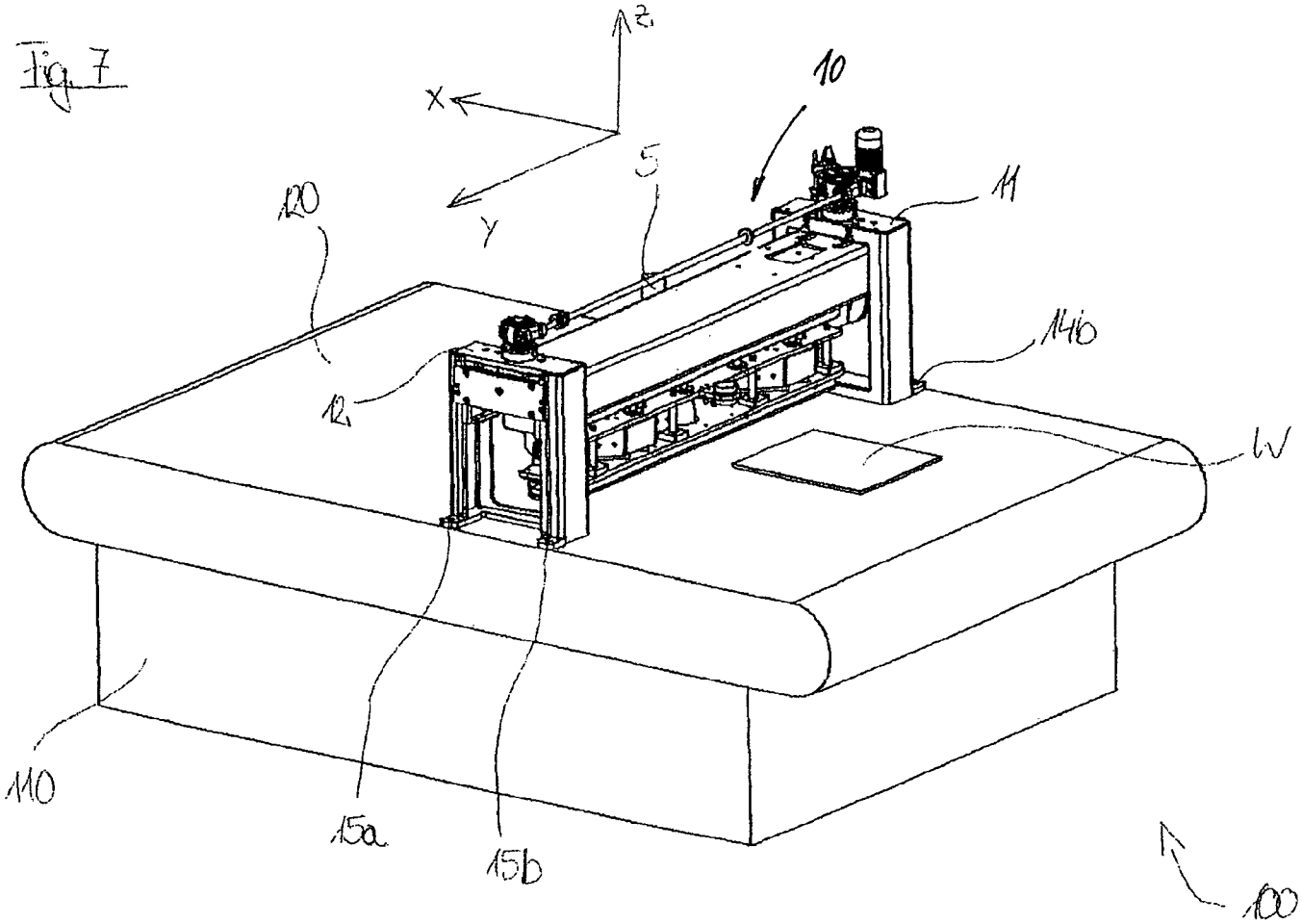

FIG. 7 shows a grinding machine having the inventive aggregate in a perspective view.

Figure 8:
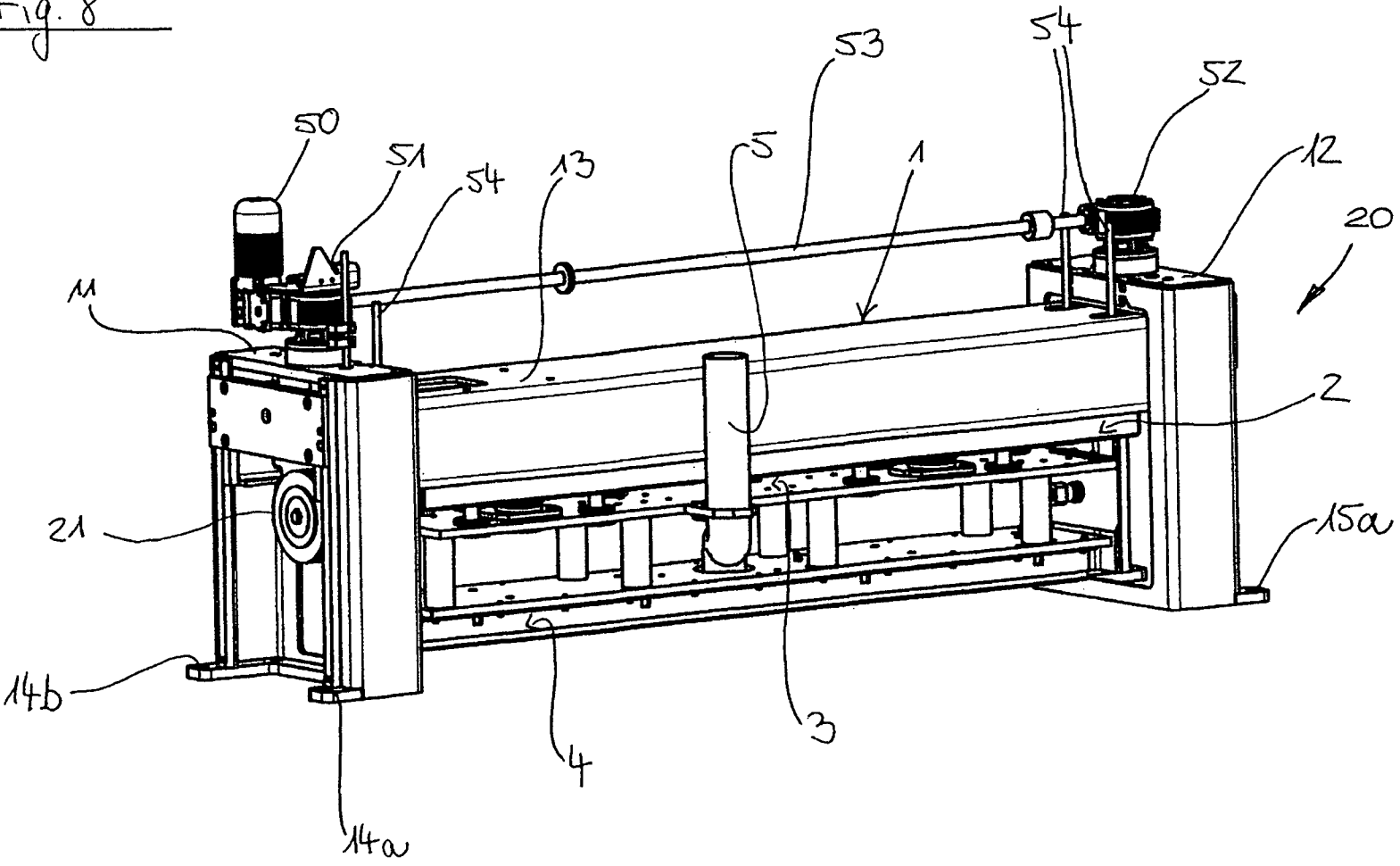

FIG. 8 shows a perspective view of a grinding aggregate according to a further embodiment of the present invention.

Figure 9:
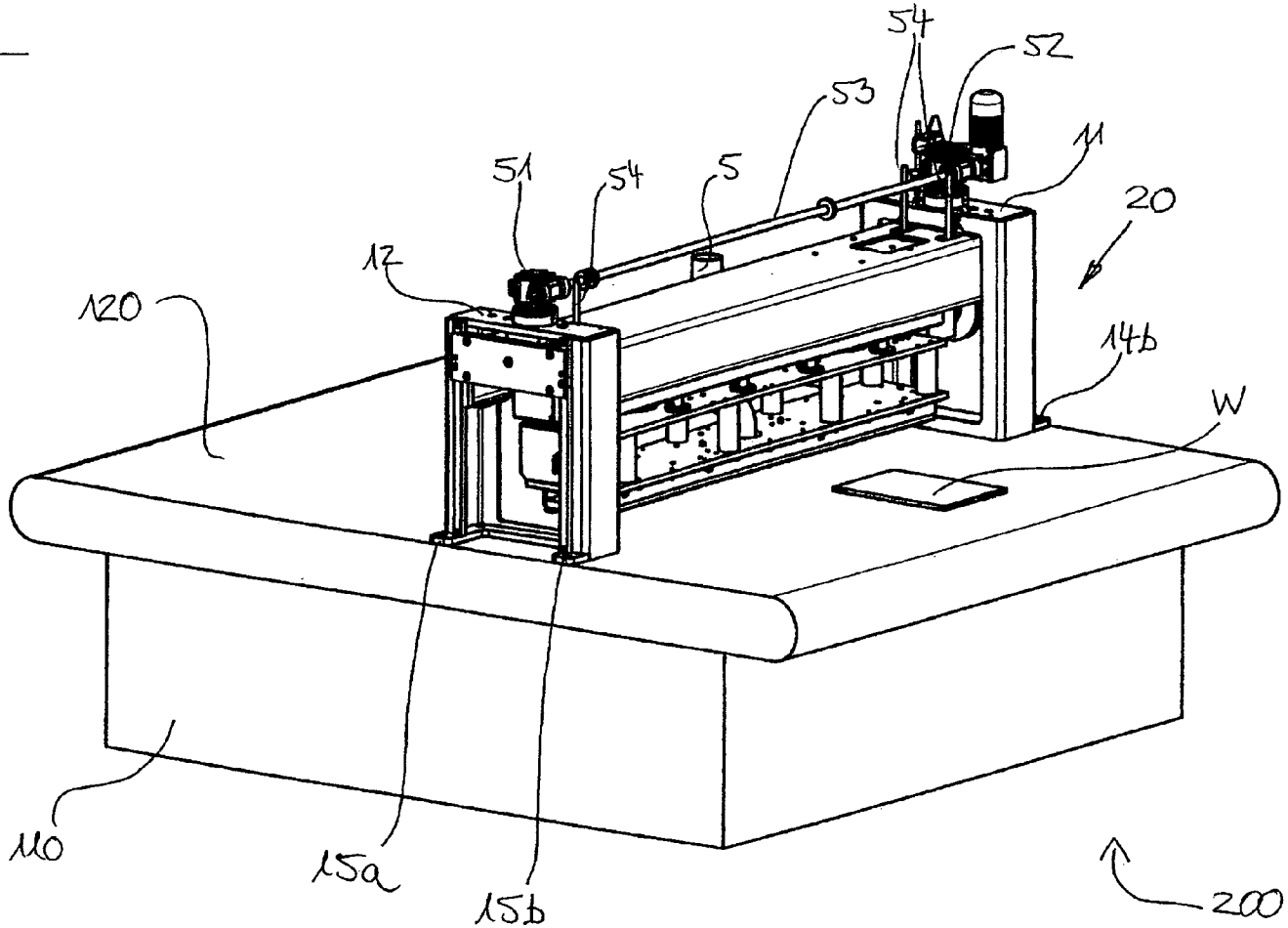

FIG. 9 shows a grinding machine having the grinding aggregate shown in FIG. 8.

DETAILED DESCRIPTION OF PREFERRED EMBODIMENTS

Figure 1:
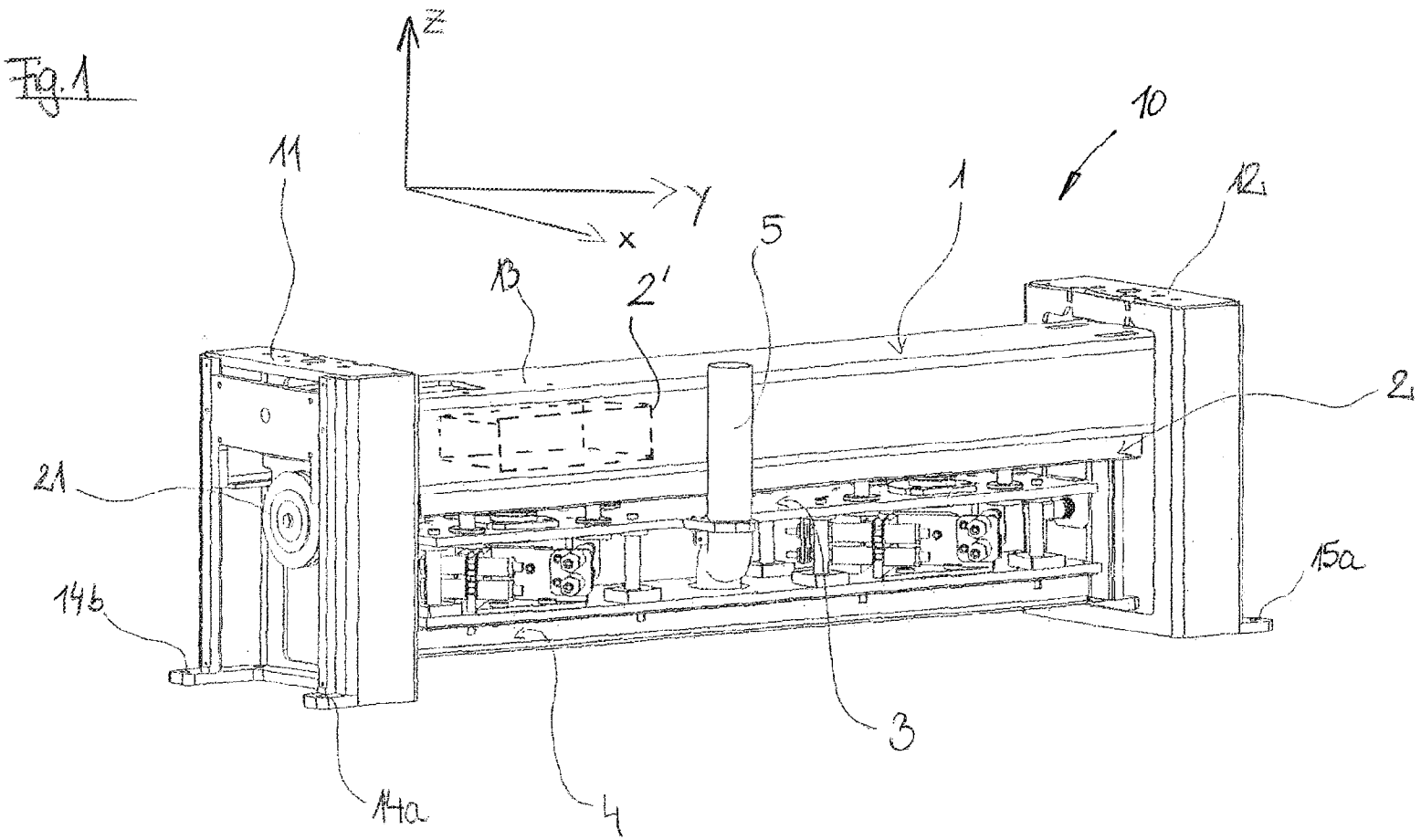
Figure 2A:
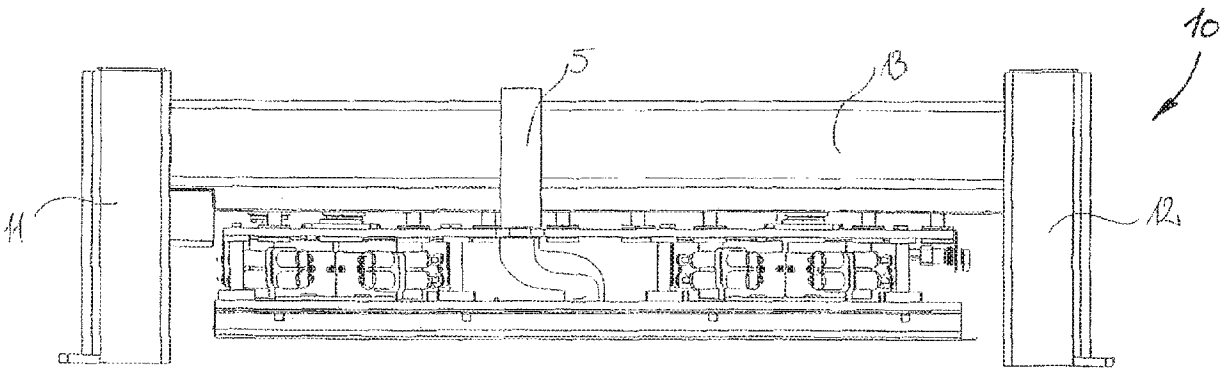
Figure 2B:
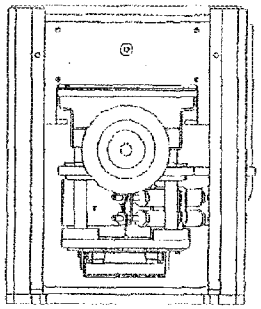
Figure 2C:
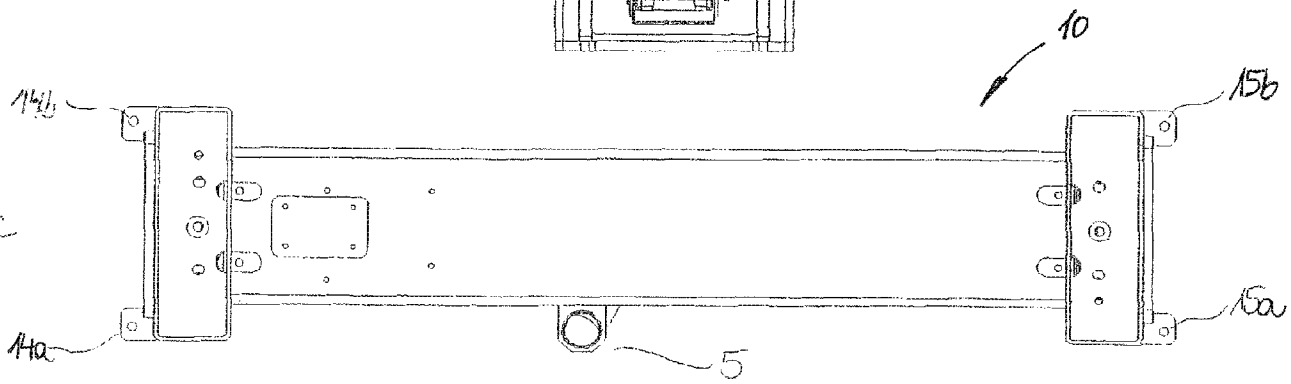

A grinding aggregate 10 according to an embodiment of the present invention is shown in FIG. 1 in a perspective view. This grinding aggregate may be mounted on a grinding machine, not shown in this view, for example a grinding machine 100 according to FIG. 7.

The essential elements of the grinding aggregate are the support housing 1, the cartridge element 2 and the oscillating module composed of an upper part 3 and a lower part 4.

The support housing 1 is mounted immovably (fixedly) with respect to the grinding machine. As can be seen in FIG. 1, it comprises essentially two column elements 11, 12 and a beam (support) element 13 connecting these column elements. The cartridge element 2 is releasably attached to the beam element 13. At the side of the respective column elements 11, 12 facing the grinding machine attachment devices 14*a*, 14*b*, 15*a*, 15*b* can be seen. These attachment devices are configured as bores so that the support housing 1 can be attached to the frame of a grinding machine by means of screw coupling (screwed joints). Apart from non-positive joints it is conceivable to use positive or material-bonded joints.

Further, one can see a suctioning device 5 attached to the lower part 4, which comprises a suctioning hose 5 and a suctioning aggregate not shown in greater detail. The suctioning hose 5 is led past the support housing 1 and is configured to remove waste products created during the grinding operation, such as chips or dust, through the grinding means. The method of removing the waste products through the grinding means shown in the present embodiment is also referred to as internal suctioning. To that end, the grinding means 8 is formed as permeable grinding means, preferably as porous grinding means or grinding web, so that chips or dust may pass trough the grinding means. The grinding means 8 is, in turn, provided with a hook-and-loop-layer not shown in greater detail in order to fix it to the grinding means holder 6.

By means of the internal suctioning, it is possible to clean the grinding means directly during grinding. This operation increases the lifespan of the grinding means 8 to a great extent and has the advantage that external suctioning is not necessary or necessary only in certain cases. This in turn saves space and possibly leads to less energy consumption. The grinding dust created due to the grinding operation is suctioned away through an air and dust permeable grinding means 8. The internal suctioning also leads to longer maintenance intervals for the aggregate.

Apart from the above structure of the grinding means, it can also be structured differently since this system is to be utilized in all grinding aggregates. It is thus conceivable to use it with endless tapes in which the suctioning may then be configured differently.

Figure 3:
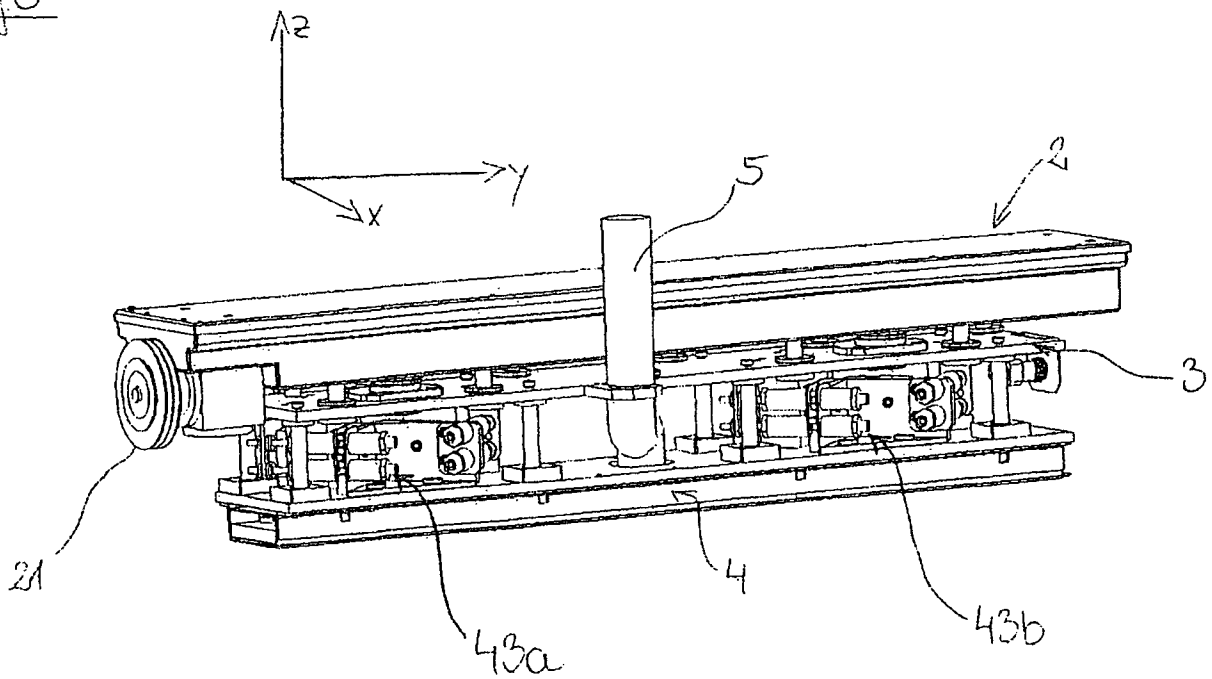
FIG. 3 shows a selection of specific elements of the inventive grinding aggregate without the fixed support housing.

Upon using the inventive grinding aggregate, the cartridge element 2 shown in FIG. 3 is put into a translational motion with respect to the fixed support housing 1 by means of a driving means 2'. This translational motion of the cartridge element with respect to the support housing 1 occurs substantially along the Y-axis. Apart from its housing, the cartridge element 2 itself comprises a v-belt pulley 21 which is provided at a side of the housing of the cartridge element 2. The frequency of the translational motion may be adjusted continuously.

Further, a angular gear is provided in the cartridge element 2. Thus, by means of a v-belt the v-belt pulley 21 can be driven, as well as several eccentric shafts via the angular gear provided in the housing of the cartridge element 2.

Figure 4:
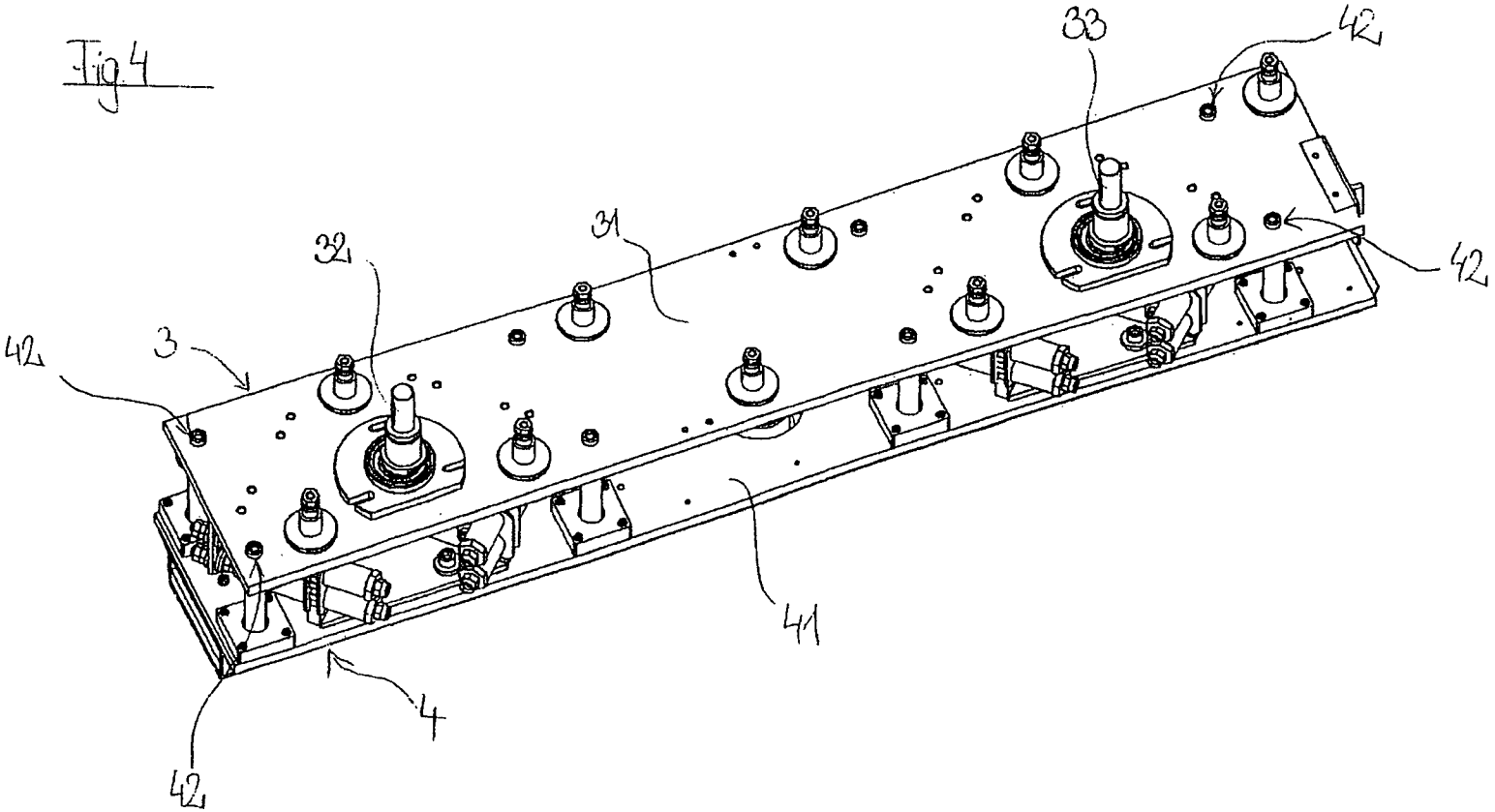
FIG. 4 shows the oscillating module of the present invention, which can also be discerned in FIGS. 1 and 3.

FIG. 4 shows the oscillating module provided on element 2, which oscillating module is composed of an upper part 3 and a lower part 4. The upper part 3 comprises a support element 31 extending in the direction of the Y-axis. A first eccentric shaft 32 and a second eccentric shaft 33 are provided on this support element.

At this point it is to be emphasized that in the embodiment shown in FIG. 4 more or less eccentric shafts 32, 33 may be provided to rotatingly drive the oscillating element, too. The only essential thing is that the oscillating module performs a circular-type or rotating motion with respect to the cartridge element 2.

Apart from the preferred circular motion also an elliptical motion is of course conceivable in order to achieve the advantageous characteristics and objects of the present invention. The above-mentioned motion between the cartridge element 2 and the oscillating module 3, 4 is termed second motion and is thus of a circular type or elliptical. The speed of the rotating motion may be adjusted continuously.

The lower part 4 comprises a support plate 41 which is substantially rectangular. In the zone of the corners the support plate 41 is provided with a total of four connection pins 42 in order to connect the lower part 4 with the upper part 3. It is important that a motion in the X-Y-plane is allowed between the upper and the lower part, while no motion is performed in the Z-direction. Thus, the oscillating module may move in itself i.e. the element's upper and lower part oscillate against each other.

The motion is performed by means of pairs of oscillating magnets 43*a* and 43*b*. Both pairs of oscillating magnets 43*a* and 43*b* are fixedly mounted to the lower part 4. By means of an alternating excitation of the respective oscillating magnets, a motion between the upper part 4 and the lower part 3 is thus generated.

In use, the operating parameters of the oscillating magnets may be adjusted independently of each other and also independently of any further elements for exciting the grinding means. With oscillating magnets, this concerns frequency and amplitude. Also, all excitation elements already mentioned may be switched on or off independently of each other.

FIG. 5 essentially shows in a perspective view the grinding aggregate 10 already shown in FIG. 1, but seen from below. Here, the detailed view of FIG. 5 shows the attachment of the grinding means holder 6 and the grinding means 8 to the lower part 4 in greater detail. The grinding means holder 6 is formed as so-called grinding tongue. This grinding tongue 6 is shown again separately in FIG. 6 and comprises a plurality of holes 6*a*. In the illustrated embodiment, these holes extend in two parallel rows along the Y-axis and are aligned in the Z-axis direction. Further, the grinding tongue 6 is provided with two further holes 6*b* on a side of the grinding tongue, which holes serve to better remove the grinding tongue from the lower part (removal aid).

The grinding tongue 6 itself has a layered structure. A rubber strip is glued onto a plate, the rubber strip itself being somewhat narrower than the plate that receives it. Onto this rubber strip, in turn, a self-adhesive hook-and-loop band is attached or adhered. All these layers are, as shown in FIG. 6, provided with holes 6*a* in order to ensure a suctioning therethrough. The grinding means 8, which is present in stripes, is fixedly held on the hook-and-loop band. It is so permeable that no additional hole pattern (holes 6*a*) are necessary.

In practice, it turned out that the suctioning through the described plate having a grinding means spaced apart therefrom results in a good distribution of the suctioning power across the entire grinding means 8. In other words, suctioning occurs not only in the immediate region of the holes 6*a*, but a negative pressure of relatively uniform distribution is created between the plates 6 and the grinding means 8. Thus, a uniform suctioning can be ensured.

All above-mentioned elements, i.e. the grinding tongue 6 having the plate, the rubber strip and the hook-and-loop band as well as the grinding means, are referred to as grinding tongue and are inserted into a mount (bracket) in the lower part 4, shown in detail in FIG. 5, and are clamped therein. Despite the clamping it is ensured that the grinding means 8 always constitutes the lowest plane with respect to the processed workpiece W. In other words, no other elements apart form the grinding means 8 of the lower part 4 contact (abut) the workpiece W to be processed. As mentioned above, when using internal suctioning, the grinding means 8 is formed as grinding web so that grinding waste products can pass through the grinding means 8.

In FIG. 7 a grinding machine 100 is shown in a schematic view, which comprises the inventive grinding aggregate 10. Here, the grinding machine 100 comprises a machine bed 110 upon which the grinding aggregate 10 according to the invention is mounted. Further, the grinding machine 100 is provided with a conveyer belt 120 configured to move a workpiece W in the X-direction. Thus, the workpiece W can be loaded by hand or by machine onto the conveyer belt and is conveyed through under the grinding aggregate by the conveyer belt, wherein the workpiece W is contacted by the grinding means 8 upon processing. Subsequently, the workpiece W is conveyed away from the grinding aggregate. The mentioned conveying and processing steps are thus performed preferably in a through-feeding arrangement.

FIG. 8 shows a further embodiment of a grinding aggregate 20 according to the present invention. In contrast to the embodiment shown above, in the grinding aggregate 20 shown in FIG. 8 no oscillating modules are provided, and the upper part 3 and the lower part 4 are rigidly connected to each other or are immovable with respect to each other. Both parts may also be integrally formed. Thus, by means of this grinding aggregate 20, a dual superimposed motion is performed. Further, this grinding aggregate 20 is provided with a suctioning which suctions through the grinding means 8 during the grinding operation. By means of these measures a superior grinding result is achieved.

The additional elements described in the following in connection with the grinding aggregate 20 according to the further embodiment may also be used in the grinding aggregate shown in FIGS. 1 to 7. The same components are provided with corresponding reference signs.

As already shown in FIG. 7, a gear unit 51, 52 is correspondingly attached on each of the column elements 11, 12, which gear units are connected to each other by means of a mechanical link 53. The gear units 51, 52 are driven by a motor 50 mounted on the gear unit 51. By means of this mechanism, a height adjustment in a vertical direction can be performed by means of a positioning system. As an alternative thereto, a manual positioning (feed) of the grinding means may be mentioned here.

Vertically extended marks 54, shown in FIG. 8, determine the locations at which fixation screws are provided in order to join the cartridge element 2 to the beam element 13. In this way, a quick release device can be implemented in order to enable a rapid replacement of the cartridge element 2.

FIG. 9 shows a view of the grinding machine 200 having the grinding aggregate 20 shown in FIG. 8. Thus, this embodiment differs from the grinding machine 100 essentially in that the grinding aggregate used does not comprise oscillating modules.

The invention claimed is:

1. A grinding aggregate of a grinding machine having a displaceable air and dust permeable grinding element for processing a workpiece comprising:

at least one translational driving device configured to translate the grinding element;

at least one eccentric tappet configured to rotatingly move the grinding element;

a suctioning device facing a surface of the grinding element that is opposite a grinding surface such that the suctioning device suctions waste products through the grinding element prior to entering the suctioning device; and a grinding element holder adapted to hold and press the grinding element onto the workpiece, said grinding element holder having a plurality of through holes in communication with the suctioning device, wherein the grinding element includes a closed, but air and dust permeable surface that is spaced apart from the grinding element holder, thereby forming a relatively uniform negative pressure distribution between the grinding element holder and the grinding element.

2. The grinding aggregate according to claim 1, wherein the grinding element further comprises at least in sections a porous structure.

3. The grinding aggregate according to claim 1, wherein the grinding element is releasably mounted onto the grinding element holder, the grinding element holder including a hook-and-loop fastener.

4. The grinding aggregate according to claim 1 further comprising:

at least one oscillating module holding the grinding element and configured to put the grinding element into an oscillating motion.

5. The grinding aggregate according to claim 4, wherein the oscillating module is moved oscillatingly in itself in a frequency range of preferably 30 to 100 Hz.

6. The grinding aggregate according to claim 4, wherein the grinding aggregate comprises an upper and a lower part which can be moved against each other.

7. The grinding aggregate according to claim 6, wherein the grinding element is attached at the lower part of the oscillating module.

8. The grinding aggregate according to claim 7, wherein the upper and the lower part can be moved by means of oscillating magnets.

9. The grinding aggregate according to claim 8, wherein the oscillating magnets include at least two pairs of oscillating magnets arranged at an angle of substantially 90 degrees to each other and are provided between the upper and lower part.

10. The grinding aggregate according to claim 4, wherein the at least one eccentric tappet performs a rotating motion between the oscillating module holding the grinding element and a cartridge element.

11. The grinding aggregate according to claim 10, wherein the cartridge element performs the translational motion with respect to a fixed support housing of the grinding machine by means of a translational driving device.

12. The grinding aggregate according to claim 11, wherein the cartridge element of the grinding aggregate is releasably attached to the fixed support housing.

13. The grinding aggregate according to claim 10, wherein the at least one eccentric tappet is performed by means of a v-belt pulley attached laterally on the cartridge element and via an angular gear.

14. The grinding aggregate according to claim 10, wherein the driving device moves the cartridge element in a translational direction wherein the translational direction may be transverse to a workpiece conveying direction.

15. A method of grinding a workpiece, the method comprising the steps of:

introducing the workpiece into a processing region so that the workpiece comes into contact with an air and dust permeable grinding element, grinding the workpiece by moving the grinding element with at least two motions independent from each other, namely a translational and a rotational motion, suctioning waste products through the grinding element using a suction device, wherein the suction device faces towards a surface of the grinding element opposite to a grinding surface so as to suction the waste products through the grinding element before entering the suction device, wherein the grinding element includes a closed, but air and dust permeable surface mounted to a grinding element holder that holds the grinding element onto the workpiece, the grinding element holder including a plurality of through holes in communication with the suction device, and wherein the closed, but air and dust permeable surface of the grinding element is spaced apart from the grinding element holder, thereby forming a relatively uniform negative pressure distribution between the grinding element holder and the grinding element.

16. The method according to claim 15, wherein the motion of the grinding element further comprises an oscillating motion.

17. The method according to claim 16, wherein the oscillating motion is a triangular motion, wherein the motion is generated by at least two oscillating magnets aligned substantially at 90 degrees to each other, wherein the oscillating magnets may be alternately excited preferably in a range of 30 to 100 Hertz.

18. The method of claim 15, wherein the workpiece are moved by a conveyor belt during grinding with respect to the grinding element in a direction.

19. The method according to claim 15, wherein the motions of the grinding device with respect to the workpiece are performed in one plane.

20. The method according to claim 15, wherein the rotational motion is excited by at least one eccentric tappet.

* * * * *